US010066417B1

(12) United States Patent
Linyard et al.

(10) Patent No.: US 10,066,417 B1
(45) Date of Patent: Sep. 4, 2018

(54) WIND RESISTANT COLLAPSIBLE CANOPY AND METHOD OF ERECTING A COLLAPSIBLE CANOPY

(71) Applicants: Grayson Lee Linyard, Garland, TX (US); Benjamin James Linyard, Flint, TX (US)

(72) Inventors: Grayson Lee Linyard, Garland, TX (US); Benjamin James Linyard, Flint, TX (US)

( * ) Notice: Subject to any disclaimer, the term of this patent is extended or adjusted under 35 U.S.C. 154(b) by 0 days.

(21) Appl. No.: 14/884,763

(22) Filed: Oct. 16, 2015

Related U.S. Application Data

(60) Provisional application No. 62/065,648, filed on Oct. 18, 2014.

(51) Int. Cl.

| | |
|---|---|
| ***E04H 15/36*** | (2006.01) |
| ***E04H 15/40*** | (2006.01) |
| ***E04H 15/60*** | (2006.01) |
| ***E04H 15/54*** | (2006.01) |
| ***E04H 15/62*** | (2006.01) |

(52) U.S. Cl.
CPC ..... *E04H 15/405* (2013.01); *E04H 15/36* (2013.01); *E04H 15/54* (2013.01); *E04H 15/60* (2013.01); *E04H 15/62* (2013.01)

(58) Field of Classification Search
CPC ..... E04H 15/60; E04H 15/62; E04H 15/40; E04H 15/36; E04H 15/54; E04H 15/56; E04H 12/2215; E04H 15/405; E04H 12/2253
USPC ..... 135/124, 136, 114, 118, 905, 116–117, 135/119
See application file for complete search history.

(56) References Cited

U.S. PATENT DOCUMENTS

| | | | | |
|---|---|---|---|---|
| 5,546,971 | A * | 8/1996 | Leonhardt | E04H 15/003 135/123 |
| 5,823,217 | A * | 10/1998 | Rice | E04H 15/003 135/124 |
| 5,927,311 | A * | 7/1999 | Jager | E04H 15/003 135/124 |
| D555,748 | S * | 11/2007 | Gyr | D21/837 |
| 7,316,239 | B2 * | 1/2008 | Yang | E04H 15/003 135/117 |
| 7,654,277 | B1 * | 2/2010 | Brewer | E04H 12/2215 135/118 |
| 7,766,022 | B2 * | 8/2010 | Livacich | E04H 15/001 135/95 |
| 7,950,406 | B2 * | 5/2011 | Raniere | A63C 19/12 135/124 |

(Continued)

*Primary Examiner* — Winnie Yip

(57) ABSTRACT

A collapsible canopy and method of erecting a collapsible canopy comprised of earth anchors, flexible members, and a canopy cover. The collapsible canopy is comprised of four earth anchors, flexible members, and a canopy cover. The method of erecting a collapsible canopy comprises the steps of using a ground template to sequentially determine the proper locations of the earth anchors in the ground, securing each earth anchor into the ground at its proper location as determined by the ground template, securing the canopy frame into the earth anchors, and securing the canopy cover to the canopy frame and/or earth anchors. The result is a collapsible canopy that is braced in all directions to withstand high winds, and a method of erecting a structurally robust collapsible canopy that one person can complete, alone, and in inclement weather.

2 Claims, 13 Drawing Sheets

(56) References Cited

U.S. PATENT DOCUMENTS

| | | | | |
|---|---|---|---|---|
| 8,001,986 | B2 * | 8/2011 | Shumate | E04H 15/62 135/116 |
| 8,789,550 | B2 * | 7/2014 | Livacich | E04H 15/001 135/114 |
| 2002/0020439 | A1 * | 2/2002 | Tate | E04H 15/425 135/124 |
| 2003/0000563 | A1 * | 1/2003 | Kuperman | E04H 15/40 135/121 |
| 2011/0108078 | A1 * | 5/2011 | Roman | E04H 15/001 135/121 |

* cited by examiner

WIND RESISTANT COLLAPSIBLE CANOPY AND METHOD OF ERECTING A COLLAPSIBLE CANOPY

CROSS-REFERENCE TO RELATED APPLICATIONS

This application claims the benefit of provisional application No. 62/065,648, filed Oct. 18, 2014; Name of Applicant: Grayson Lee Linyard; Title of Invention: Wind Resistant Collapsible Canopy and Method of Erecting Collapsible Canopy.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION

(1) Field of the Invention

The field of the invention is collapsible canopies, tents, shelters, and sun shades for outdoor use to protect against the sun, wind, and rain, and methods for erecting the same.

(2) Description of Related Art Including Information Disclosed Under 37 C.F.R. 1.97 and 1.98

Various forms of collapsible shelters; canopies, and sun shades currently exist. The relevant known prior art is as follows: U.S. Pat. No. 5,823,217A, U.S. Pat. No. 8,453,664B2; WO2011012969A2; U.S. Pat. No. 5,927,311A; U.S. Pat. No. 3,042,053A; and U.S. Pat. No. 7,654,277B1. These are all collapsible, curved-arch canopies, with the arches being parallel to each other. The general "tunnel shape" created by the parallel arches provides more shade than a traditional overhead canopy while allowing the user high visibility in two directions. However, none of prior art canopies are both easily erectable and equipped to withstand high winds and inclement weather. The increasing concern of sun exposure and popularity of outdoor activities has prompted a need for a lightweight, collapsible canopy that can be easily transported and erected and; once erected, will withstand high winds and inclement weather.

Various collapsible canopies that somehow make use of the earth also exist. The relevant known prior art is as follows: U.S. Pat. No. 7,654,277, U.S. Pat. No. 5,927,311A, U.S. Pat. No. 6,502,593 U.S. Pat. No. 3,042,053A, and U.S. Pat. No. 5,036,874. However, prior art collapsible canopies that make use of the earth are either too complicated for general use or not structurally sound enough to make their use practicable. Additionally, no method currently exists that allows a user to quickly and easily erect a portable, collapsible canopy secured into the ground that is both practicable for general use and structurally sound enough to withstand high winds and inclement weather.

BRIEF SUMMARY OF THE INVENTION

A collapsible canopy and method of erecting a collapsible canopy that results in a canopy that is stabilized in all directions against high winds. The collapsible canopy is comprised of: four independent earth anchors; a canopy frame comprised of flexible arch-shaped members; and a canopy cover.

The method of erection of a collapsible canopy disclosed is for collapsible canopies comprised of earth anchors that are secured into the ground and receive the canopy frame, a canopy frame comprised of flexible members, and a canopy cover. The method consists of the steps of sequentially determining the proper locations of earth anchors in the ground by the use of a template; sequentially securing each earth anchor into the ground at its proper location determined by the ground template during the process; erecting and securing the canopy frame's flexible members into the earth anchors; and securing the canopy cover to the canopy frame and/or earth anchors.

DETAILED DESCRIPTION OF THE INVENTION

Figure 1:
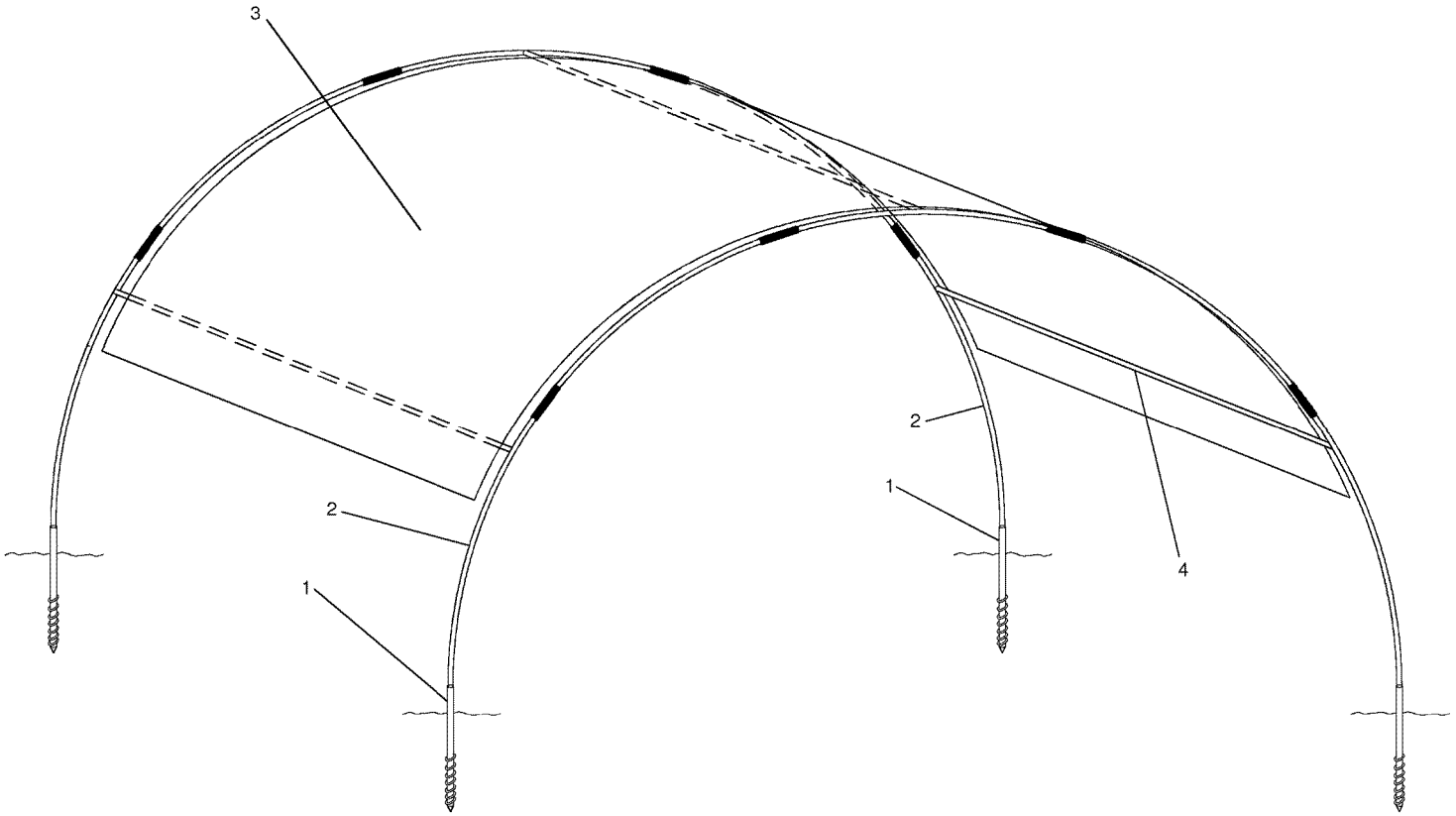
FIG. 1 shows the collapsible canopy in its set-up form.

In the present preferred embodiment of the collapsible canopy, the canopy is comprised of four earth anchors (1)

secured into the ground; two flexible arch poles (2) held in compression by forcibly securing the ends of the arches into earth anchors; (2); and a canopy cover (3) secured to the canopy frame and/or earth anchors. In the parallel-arch style canopy disclosed, the canopy is also comprised of at least one cross-member (4) secured between the parallel arches. In the overlapping- or intersecting-arch style canopy disclosed, the arches are also secured to each other at the point at which they overlap or intersect (24).

Figure 6:
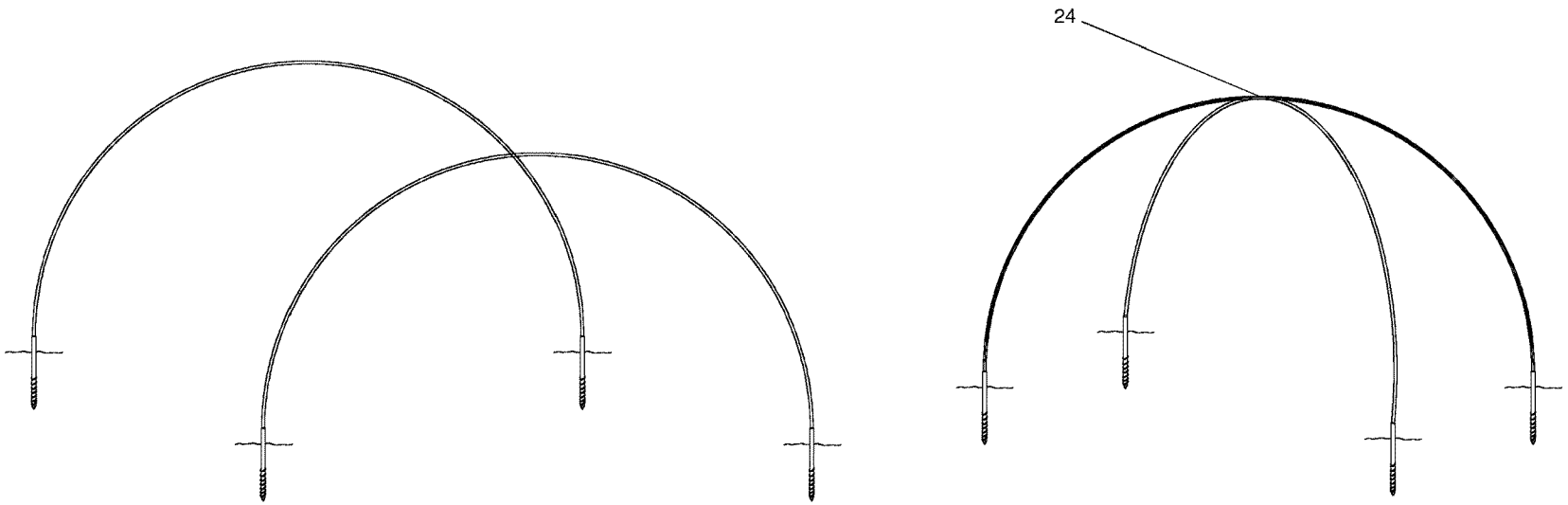
FIG. 6 shows examples of various configurations of flexible member canopies with earth anchors that can be constructed by the method disclosed.

The disclosed method of erection is for use with any collapsible canopy comprised of flexible members and earth anchors. This includes the "tunnel-shape" collapsible canopy disclosed herein (where the flexible members are arch-shaped and arraigned generally parallel to each other), and also collapsible canopies with any other configuration flexible members. For example, the flexible members may also be arch-shaped and arranged generally perpendicular to each other (as in FIG. 6), or in some other fashion in which they overlap or intersect. Use of a flexible structure that is put in compression by inserting its bases into the earth anchors allows the canopy frame to receive structural support in all directions from the ground anchors and the ground, and the outward thrust created in the canopy frame works to hold the collapsible segments of the flexible members together through outward thrust and friction.

Figure 2:
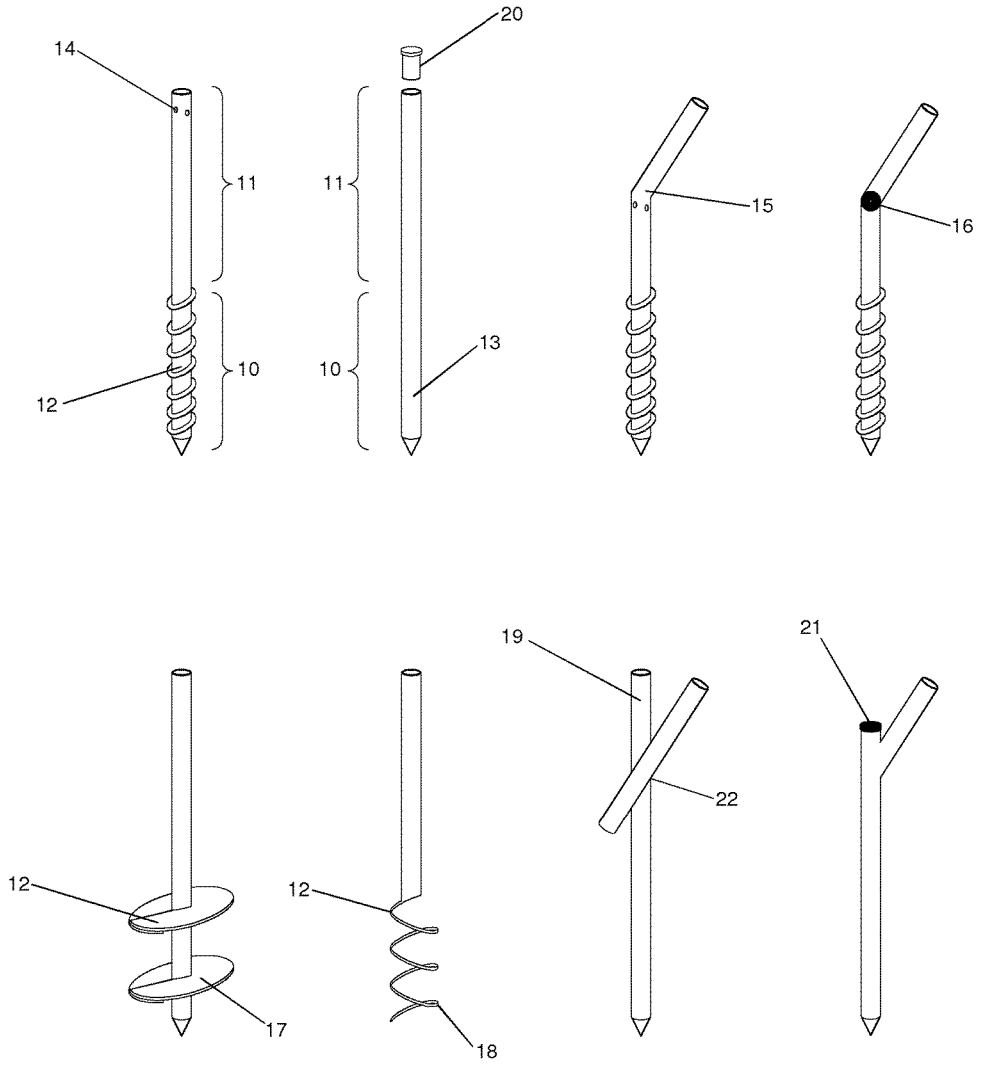
FIG. 2 shows various styles of the earth anchors.
Figure 3:
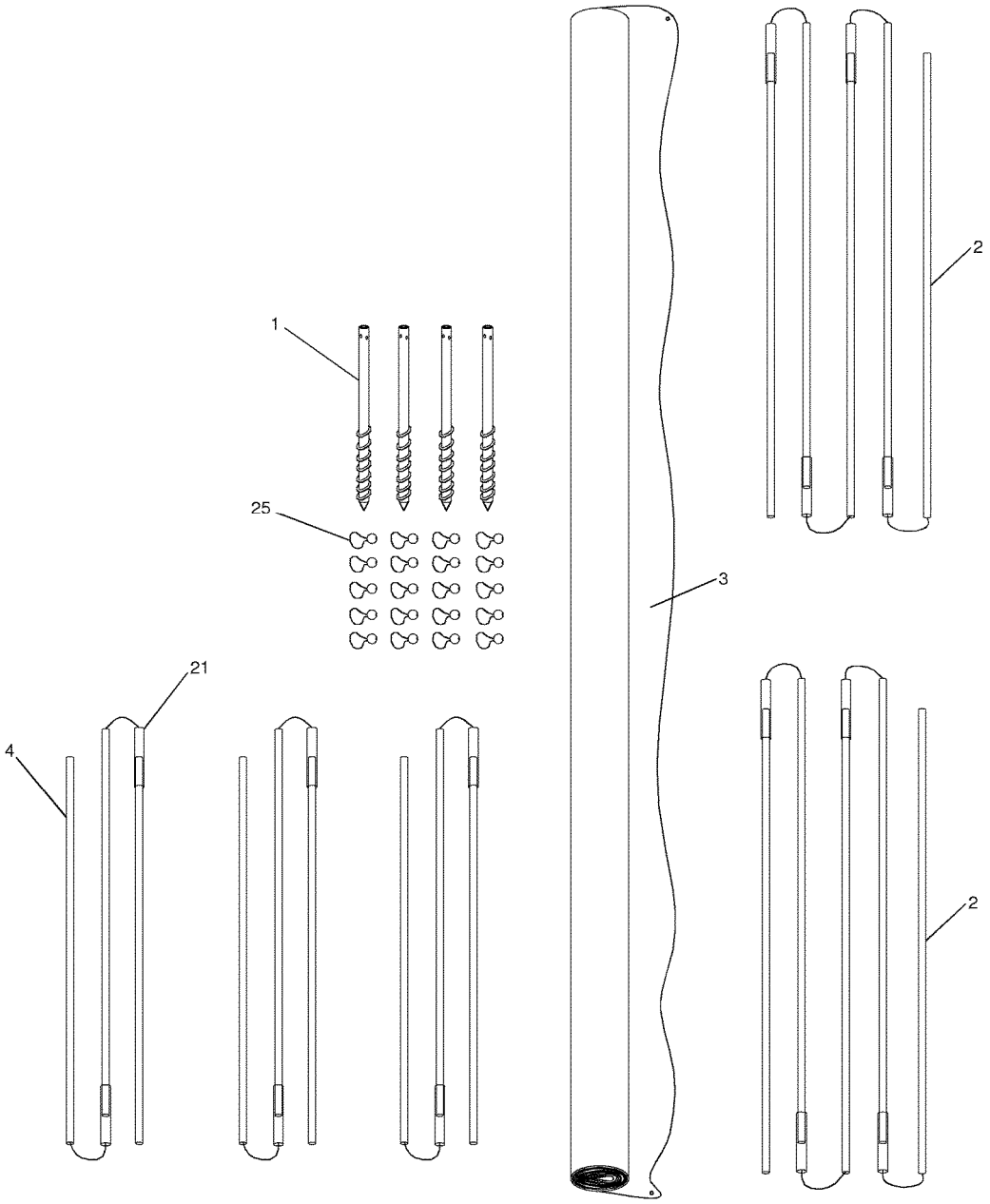
FIG. 3 shows the various elements of the canopy in collapsed form, including the cross-members used in the parallel-arch style canopy.

Each earth anchor is comprised of a "bottom" end (10) that anchors into the ground and a sleeve-type "top" end (11) for receiving the end of the arch pole. The embodiment of the earth anchors as shown in FIG. 2 is generally a tube. The bottom end of the tube is either "screw type" (12) or "stake type" (13). The sleeve-type top end of the earth anchor is formed to receive the end of an arch pole. The inside diameter of the arch-pole-receiving top end of the earth anchor should substantially correspond to the outer diameter of the arch pole, so that the arch pole slides snuggly and securely into the earth anchor.

In the present embodiment of the "screw-type" earth anchor shown in FIG. 2, the top end has two holes (14) in which a lever, rod, or handle can be placed through the top end to facilitate screwing the earth anchor into the ground. However, the holes could be replaced by permanent handles. The anchor could also be bent at a fixed angle (15). Likewise, the arch-receiving top end could also be connected to the screw-type bottom end via hinge or pivot point (16), so that the angle between the ground and the arch receiving top end can vary. Such an embodiment would allow the arch-receiving top end to also serve as a handle or lever when screwing the screw-type bottom end into the ground. However, such a "variable angle" embodiment of the screw-type earth anchor (16) should include a means of fixing the angle of the top end relative to the ground after the anchor is secured into the ground, so that the arches are resistant to sway in the plane of the hinge. There is no requirement that the screw-type bottom be hollow or tubular. The bottom end could be a traditional ground auger stake (17) or a traditional corkscrew type anchor (18), or any other means which allows the ground anchor to be screwed or twisted into the earth.

In the "stake type" earth anchor (13) the bottom end is formed as a stake to penetrate into the earth when force is applied to the top end. However, because repeated hammering or driving may deform the precise shape of the top end (especially if the anchor is made of aluminum or another malleable material), the preferred embodiment of the stake type earth anchor should have a separate top end for hammering/driving the earth anchor into the ground (19), different from the top end receiving the arch pole. Alternatively, a drive cap (20) may be placed in the arch receiving top end when hammering/driving, to distribute force equally around the rim of the top end during the process of hammering/driving. Instead of using a drive cap, the top end of the stake type earth anchor could also be fit with a rigid or rubber collar to prevent deformity from repeated hammering/driving. The sleeve top end of the stake-type earth anchor can also be bent at a fixed angle with a place for driving the anchor (21), or the arch receiving sleeve may be connected to a traditional stake at a fixed angle (22). The preferred material for constructing the earth anchors is aluminum, but could be any durable material such as steel, iron, carbon fiber, plastic, rubber, or a combination of materials.

Figure 7:
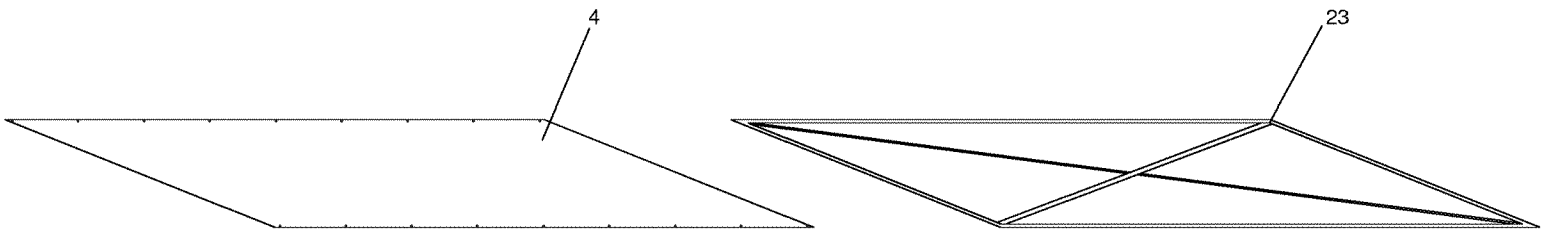
FIG. 7 shows various styles of ground templates that can be used in the method disclosed.
Figure 8:
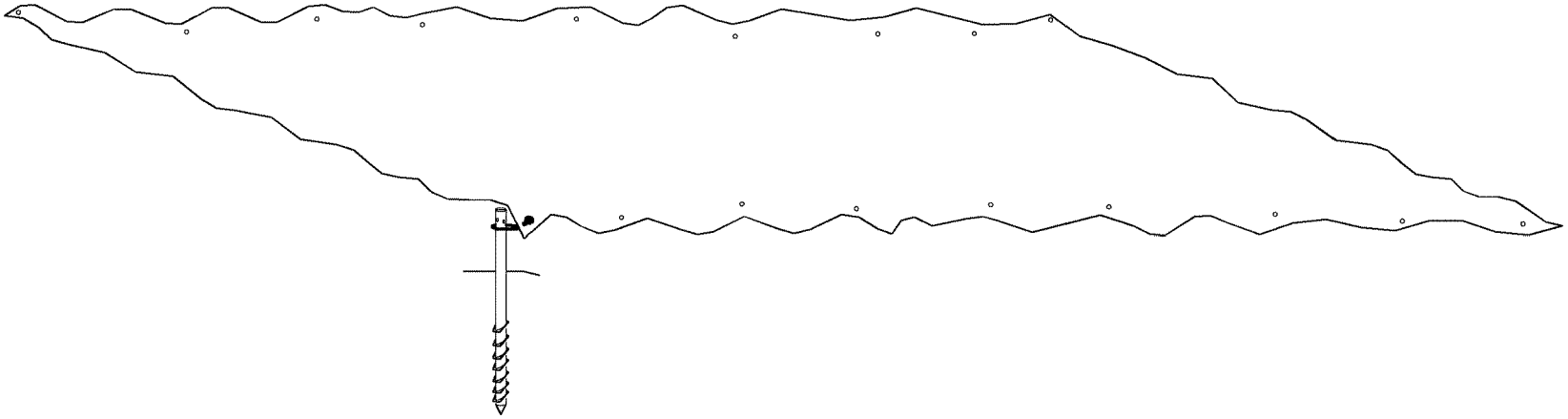
FIG. 8 shows the method of erection, wherein the first earth anchor is secured into the ground, and connected to the ground template at the ground template's first designated point.

The method for erecting the canopy begins by securing the first earth anchor into the ground by screwing or driving, depending on the type of earth anchor used (FIG. 8). After the first earth anchor is secured into the ground, the canopy cover (4) or other ground template (23) is then used as guide to determine the proper location for the remaining earth anchors. While the preferred embodiment uses the canopy cover itself as the ground template/guide, a separate plane of fabric, plastic, or vinyl could be used as the ground template. Additionally, a square or rectangle ground template may be formed out of straps, string, or cord, but such template would also need straps connecting between the two sets of opposite corners of the ground template (23). Such diagonal straps would help to ensure that the fully deployed ground template is plumb and square, comprised of four 90 degree angles, as shown in FIG. 7, and would help prevent the square or rectangle template from distorting into a rhombus when fully deployed along the ground.

Figure 9:
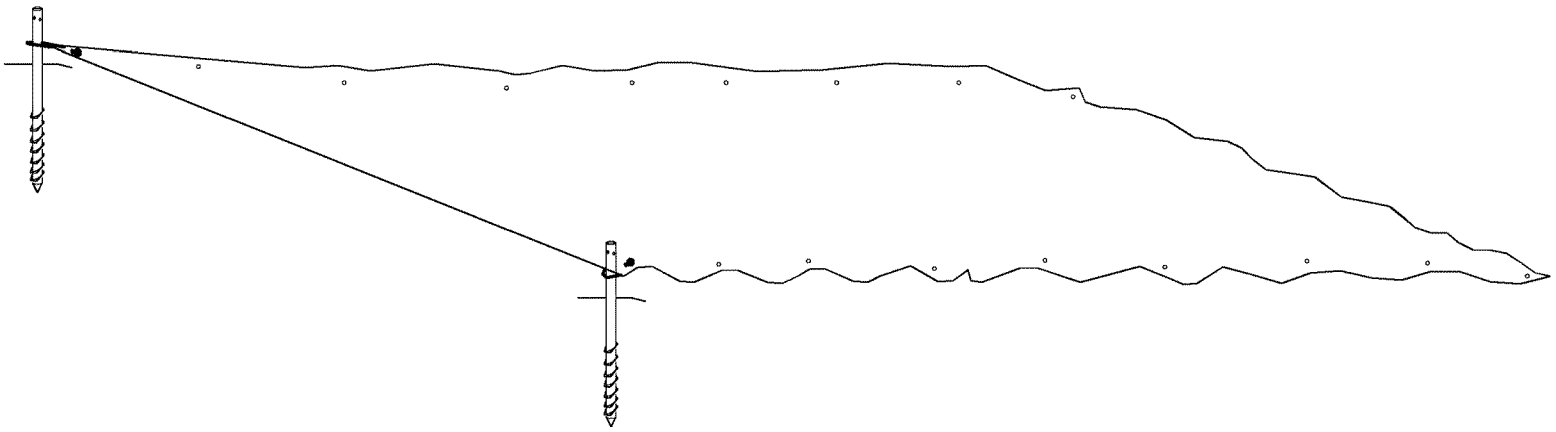
FIG. 9 shows the method of erection, wherein the ground template is pulled taut along the ground to its second designated point, and the second earth anchor is secured into the ground at that point and connected to the ground template.
Figure 10:
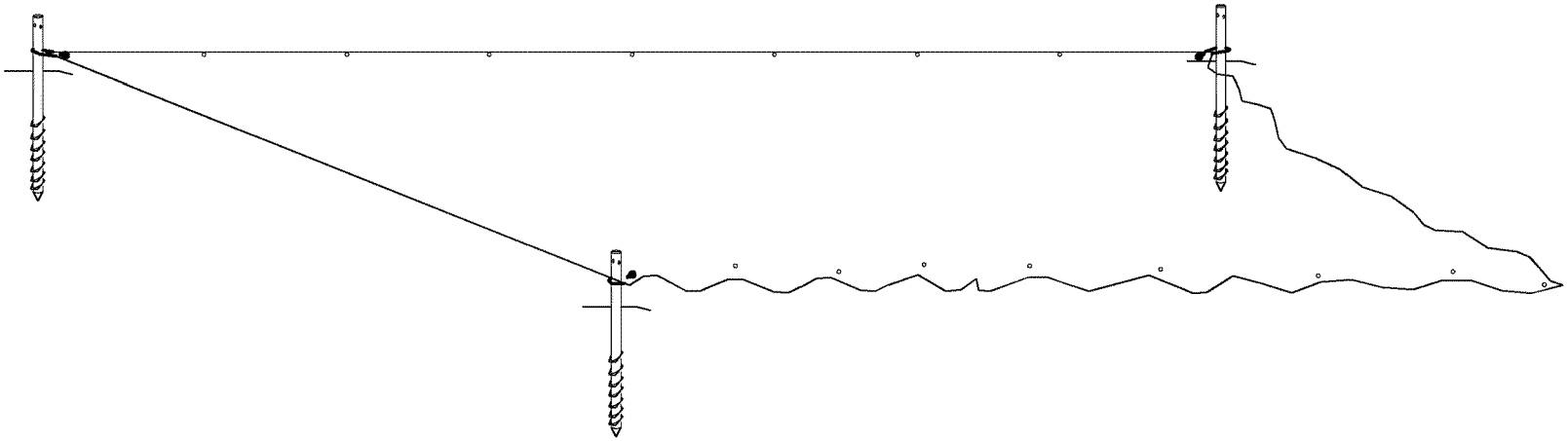
FIG. 10 shows the method of erection, wherein the ground template is pulled taut along the ground to its third designated point, and the third earth anchor is secured into the ground at that point and connected to the ground template.
Figure 11:
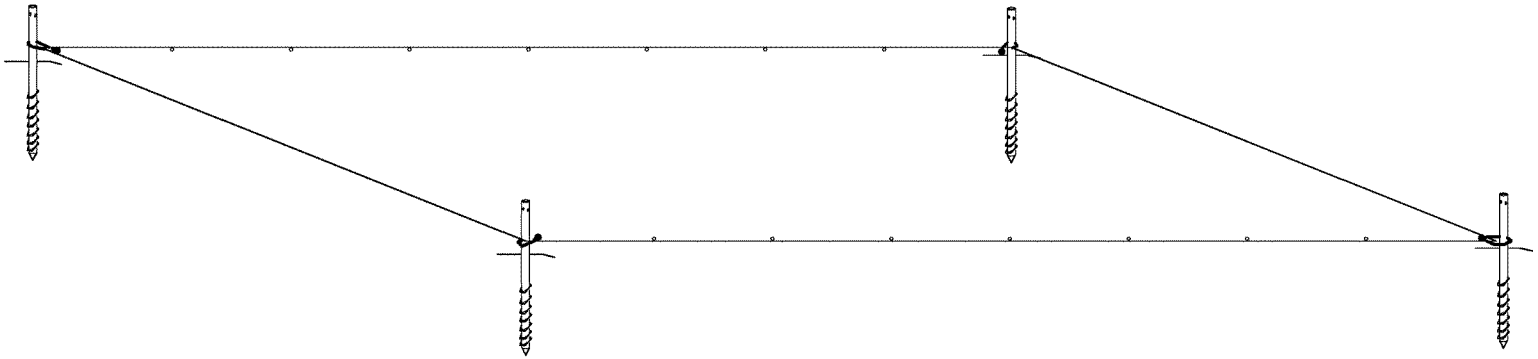
FIG. 11 shows the method of erection, wherein the ground template is pulled taut along the ground to its fourth designated point, and the fourth earth anchor is secured into the ground at that point.
Figure 12:
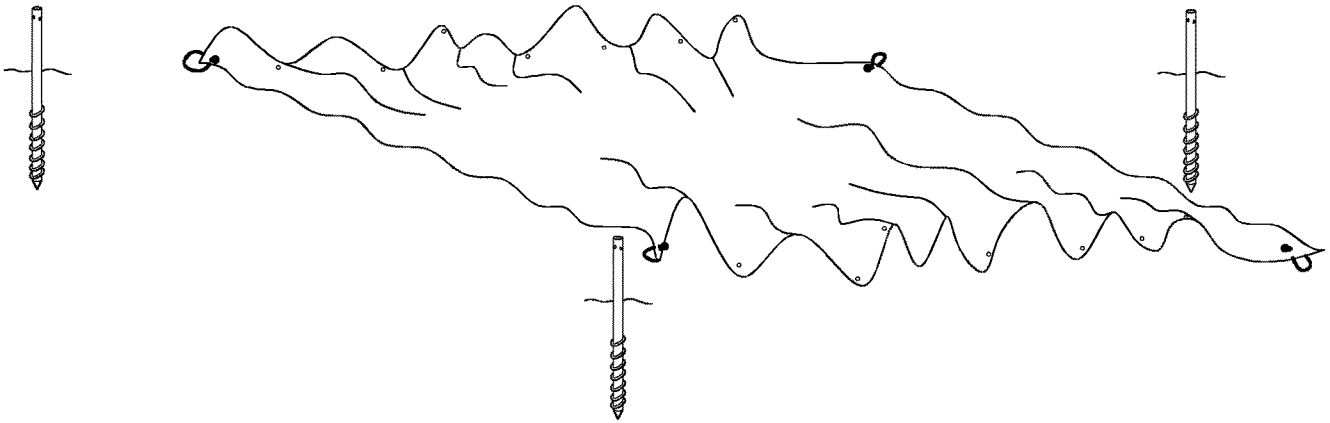
FIG. 12 shows the method of erection, wherein the template is disconnected from the earth anchors.

In the present preferred embodiment, the canopy cover is used as template and is generally rectangular. After the first earth anchor is secured into the ground, a first corner of the canopy cover or ground template is secured to the first earth anchor with a loop, tie, bungee, or other connective means (FIG. 8). From this point, the canopy cover/ground template is pulled generally taut or stretched along the ground to its second corner or designated point, which determines the placement of the second earth anchor (FIG. 9). The second earth anchor is secured into the ground at this location (determined by the ground template), and the second corner of the ground template is then similarly connected to the second earth anchor to hold it in place (FIG. 9). The canopy cover/ground template is then stretched again along the ground to its third corner, where the third earth anchor is secured into the ground at its determined location (FIG. 10). If the canopy cover is used as the ground template, the third earth anchor location may also be determined by another point designated on the canopy cover, not necessarily located at its third corner. Once the third earth anchor is secured into the ground at its proper location determined by the canopy cover/ground template, the third earth anchor is similarly connected to the third anchor at its third corner to hold it in place (FIG. 10). The canopy cover/ground template is then fully deployed over the ground and pulled taut to its fourth corner or designated point to determine the proper location of the fourth earth anchor (FIG. 11). Once the fourth earth anchor is secured into the ground at its proper location (as determined by the canopy cover/ground template), the canopy cover/ground template is disconnected from the earth anchors and set aside (FIG. 12). If the canopy cover is being used as the ground template, the canopy cover is set aside until it is secured to the canopy frame and/or earth anchors later in the process.

Using the canopy cover or other ground template to sequentially determine the proper locations of the earth anchors in the ground allows the proper locations of the earth anchors to be determined quickly, easily, and without complicated measuring. And because the canopy cover or other ground template is connected to each earth anchor sequentially during the process, one person can determine the proper locations of the earth anchors alone, and in high winds. Though the present embodiment of the canopy cover or other ground template is a rectangular shape with its corners determining the locations of the ground anchors, other shapes for the canopy cover or other ground template can be used as long as the canopy cover or other ground template is marked or designated in such a way that the proper locations of the earth anchors can be discerned from it when it is fully deployed over the ground, and the canopy cover or other ground template is equipped to be connected to the earth anchors at those locations during the process.

After the earth anchors are secured into the ground at their proper locations and the canopy cover/ground template is disconnected from the earth anchors, each of the flexible arch poles (2) are assembled and then forcibly secured into the earth anchors (FIG. 13), creating an arch or bow shape. The flexible arch poles are collapsible, with each section of the pole connected to the next section by the use of ferrules (21). The preferred embodiment of the arch pole is a collapsible pole comprised of five sections, each section four feet in length, and each section made of ¾" fiberglass rod, with eight-inch long aluminum ferrules. However, the arch poles may be constructed in any total length, any number of sections, any section length, any flexible material, and any diameter. The arch poles may also be made of tube instead of rod, and may be shock-corded together. It is also possible that the arches are constructed of part flexible material and part non-flexible material (e.g., aluminum tubes or rods), so long as the arch pole as a whole can be bent in compression to create outward thrust from its endpoints. For example, the arch pole may be constructed from four sections of aluminum tubes and one section of fiberglass rod, with the fiberglass rod section being the middle section.

Figure 13:
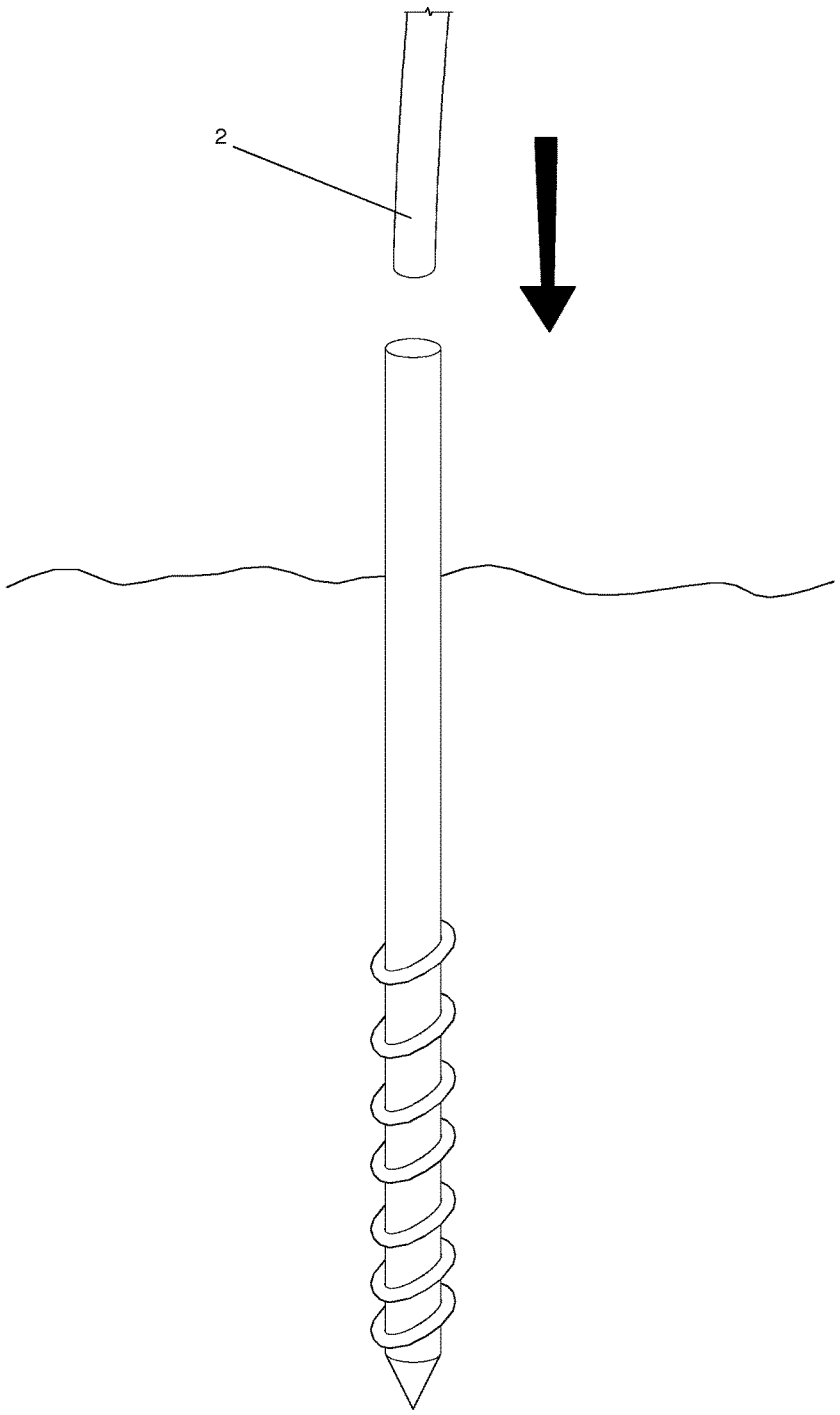
FIG. 13 shows the method of erection, wherein the ends of the flexible members of the canopy frame are secured into the earth anchors.

The arch poles are assembled and then secured into the earth anchors by sliding the ends of the arch poles into the pole-receiving top ends of the earth anchors (FIG. 13). The arch pole should slide deep and snuggly into the receiving top end of the earth anchor (11) so that the arch pole receives rigid support from the earth anchor in all directions. In the present preferred embodiment, the length of the arch pole resting within the earth anchor when fully engaged should be at least six inches.

When each flexible arch pole is engaged into the earth anchors at both ends, the significant compression in the arch exerts an outward thrust on the endpoint of each arch pole within the earth anchor. The outward thrust on each endpoint of the arch works in conjunction with the depth at which each arch pole is secured into its earth anchor to hold the arch pole securely in place inside the earth anchors. Due to the outward thrust on the ends of the arch poles and the friction created between the arch pole and the pole-receiving sleeve of the earth anchor, the bent arch poles will not pull out of the earth anchors in high winds. If the earth anchor is of the "stake-type," the outward thrust on the endpoints also serves to help hold the earth anchors securely in place in the ground. While this outward force on the earth anchors from the arch poles is also present when using a screw-type anchor, it is merely surplussage; the screw-type anchor is already held firmly in the ground by its screw-type bottom end. When the arch pole is fully engaged into the earth anchor, the arch pole receives rigid support in all directions from the earth anchor and the earth.

After the arch poles are fixed in compression by being secured into the earth anchors, for the parallel-arch canopy disclosed herein, the parallel arches are then braced laterally by at least one rigid cross member (3). The cross member is generally the same length or longer than the shortest distance between the parallel arch poles. For example, if the parallel arches are eight feet apart from each other at both of their endpoints (the lateral distance between the earth anchors), then the cross member should be generally eight feet or longer. If the cross member is generally longer than the distance between the parallel arches, the two arches must be forced in tension away from each other in order to secure the cross member in compression between them. Once connected, the cross member serves to fix the minimum distance between the parallel arches. In FIG. 1, three cross members are used, but one or more cross members can also be used. The present preferred material for the cross-member(s) is aluminum tube, shock-corded together, but other rigid tube or rod material can be used. The cross member should also be collapsible, so as to fit with the collapsed arch poles for storage and transport. The cross member could also be curved instead of straight, and/or adjustable in length.

Figure 4:
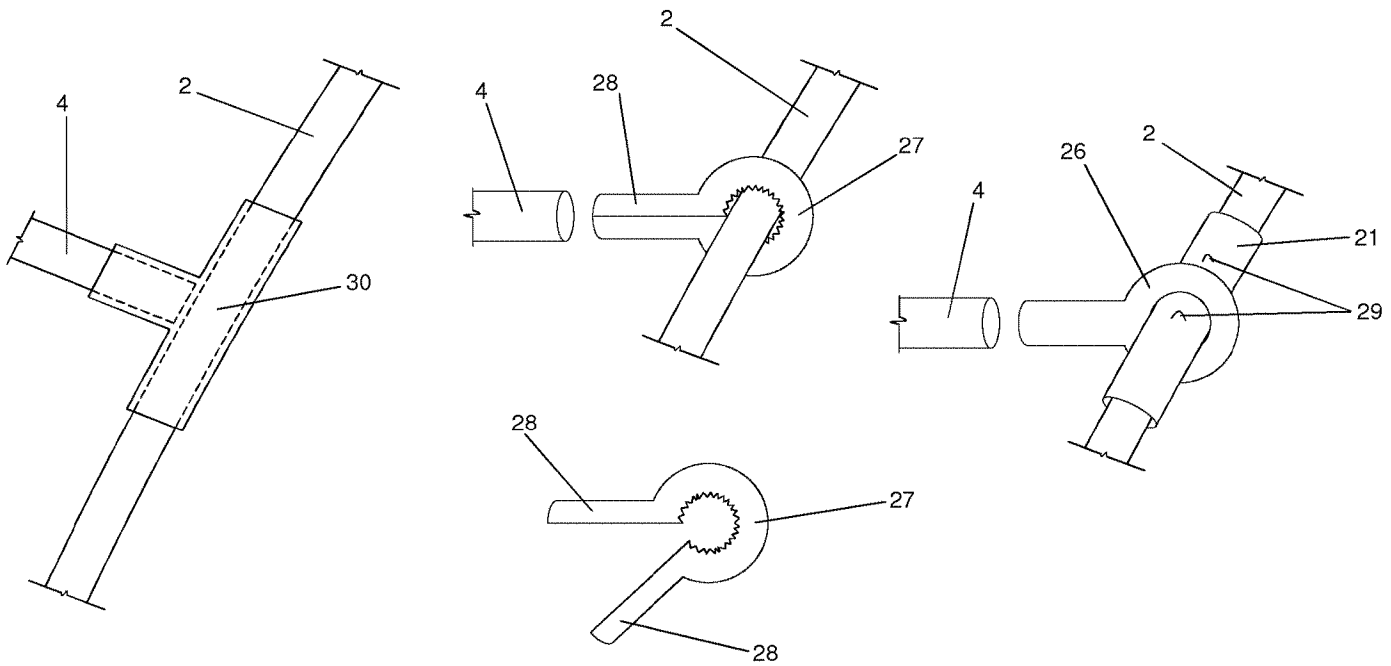
FIG. 4 shows various styles of connections of the cross-member to the flexible arch pole.

In the parallel-arch collapsible canopy disclosed herein, the cross member (4) is secured to the arch poles by connective means at both of its ends. As shown in FIG. 4, the present preferred connection of the cross member to the arch pole (2) is by sliding the end of either an "eye bolt" shaped member (26) or a clamp (27) into the hollow cross member. This type of connection makes use of the arch poles' resistance to being forced away from each other by the cross member. If clamps are used, the clamp should fit snuggly around the arch pole when engaged, and the handles of the clamp (28) should slide inside the hollow cross member. If an "eye bolt" shaped member is used, the head of the eye bolt should be affixed around the outside of a ferrule (21) with nodules (29), so that the head of the eye bolt will not slide off of the ferrule. However, the body of the eye bolt must be free to rotate around the ferrule so that it can be easily adjusted when inserting the eye bolt's body into the hollow cross member. Using clamps that close around the arch poles and have their handles inserted into the cross member allows for the locations the cross-members to be connected to the arch poles at any desired location along the arch poles. While the clamps (27) in FIG. 4 are the present preferred connection of the cross-member(s) to the arch poles, a variety of connective means can be used such as T-connectors (30), straps, Velcro, clips, C-bolts, hooks, clamps, rope, cable, etc.) to secure the cross member in place between the parallel arches.

In the method of erecting a canopy with arch poles that intersect or overlap disclosed herein, the arch poles are secured into the earth anchors, and then the arch poles are connected or secured to each other at the point at which the arch poles overlap or intersect (24) by connective means, such as the use of bungee balls or a lashing. Such connection allows each arch to received additional structural support from the other arch at this point, limiting its propensity to move or sway in the wind in any direction.

Figure 5:
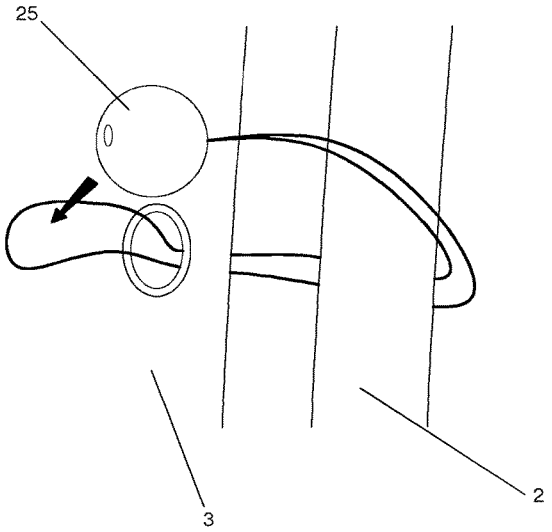
FIG. 5 shows an example of the canopy cover connection to the flexible arch pole by the use of bungee balls.

After the canopy frame is erected, the canopy cover is secured to the canopy frame and/or earth anchors. In the parallel arch canopy disclosed, the canopy cover is secured along the length of each arch pole by connective means. For example, as shown in FIG. 5, the canopy cover may be secured to the canopy frame by connecting the canopy cover's grommets or "tie loops" to the arch poles at intervals with the use of "bungee balls" (25). The canopy cover may also be connected to the arch poles by hooks, Velcro, clips, ties, or other connective means. The canopy cover may also be connected to the arch poles by the use of sleeves along both sides of the canopy cover. If sleeves are used, there should be corresponding openings in the sleeves on opposite sides of the canopy cover to allow the cross member(s) to be connected between the arch poles. Once the canopy cover is connected to the arch poles and/or earth anchors, the canopy cover serves as an additional support (along with the tension from the earth anchors) restricting the movement of the arches due to wind. The canopy cover may also be shaped to best accommodate the shape of the canopy frame. The canopy cover may also be configured to enclose the canopy frame from the ground up, including on one or more sides, creating a fully or partially enclosed tent structure. The canopy cover can be made of any material, but for best results the material should be a lightweight and protect against water and the sun's UV rays, such as vinyl, plastic, nylon, silicone, rubber, canvass, fabric, etc.

In the method of erecting a canopy with arch poles that intersect or overlap disclosed herein, the canopy cover is connected to the arch poles and or the earth anchors by connective means. For example, the canopy cover may be connected by bungee cords running from its corners to the earth anchors.

This method of erection of a collapsible canopy comprised of flexible members and ground anchors is effective whether such canopy's flexible arches are arraigned generally parallel to each other or are arraigned so that the arches overlap or intersect each other at some point (24). Once erected, the earth, earth anchors, flexible arch poles, cross member(s) (if a parallel arch configuration is used), and canopy cover all work in conjunction; all of these elements are dependent upon each other to create the overall stability to internally brace the canopy against the wind in all directions. The internal tension in multiple directions also braces the canopy against updrafts without the need for weights (that are a burden to transport) or tie-downs (that require additional space, are difficult to erect, and pose a hazard to others). The compression in the curved arches and the friction created between the arch pole and the inside sleeve of the earth anchor also eliminates the need to secure the arch poles to the earth anchors by locking means.

The result is a collapsible canopy that can be quickly and easily erected by one person that is internally braced in all directions to withstand high winds and inclement weather. Once erected, the canopy can be left up unattended without fear of structural failure. The canopy is also collapsible for easy transport and storage. By using lightweight materials such as fiberglass and aluminum, the deconstructed canopy can be transported much easier other shades or canopies of similar size, while increasing structural integrity and the amount of shade produced.

The method of erecting a collapsible, flexible canopy that uses earth anchors by sequentially determining the proper locations of the earth anchors from a ground template allows for one person to complete the process, alone, and without the need for complicated measuring. Using a ground template (such as the canopy cover) along the ground serves to determine the proper location of the earth anchors in in the easiest manner possible while still retaining the necessary exactness. Using the canopy cover as the template allows the canopy cover to serve dual purposes and save space in the bag used to transport the entire structure. The flexible nature of the canopy frame's members also allows the locations of the earth anchors to be relatively approximate, so that minimal deviation from the optimal locations of the earth anchors will not compromise the structural integrity of the canopy once erected.

SEQUENCE LISTING

Not Applicable.

The invention claimed is:

1. A method of erecting a collapsible canopy, wherein said collapsible canopy comprises: a canopy frame comprised of various members, including flexible members; earth anchors comprised of a top end for receiving an end of said canopy frame's members and a bottom end formed to screw into the ground; and a canopy cover;

the method comprising the steps of:

a. Securing a first earth anchor into the ground by screwing or twisting the earth anchor into the ground to a sufficient depth at which the earth anchor can transfer moment, shear, and axial load into the ground once a member of the canopy frame is later secured into said earth anchor;

b. Securing a ground template to the first earth anchor at said ground template's first designated point;

c. Sequentially determining the proper location of the next earth anchor by stretching said ground template taut along the ground to its next designated point;

d. Securing the next earth anchor in the ground by screwing or twisting the earth anchor into the ground at the location determined by said ground template in the previous step, to a sufficient depth at which the earth anchor can transfer moment, shear, and axial load into the ground once a member of the canopy frame is later secured into said earth anchor;

e. Repeating steps (c)-(d) until each earth anchor is secured into the ground at its proper location as sequentially determined by stretching the ground template along the ground; and if the canopy cover has been used as the ground template, disconnecting the canopy cover from any earth anchor;

f. Securing the ends of members of said canopy frame into or over the top ends of said earth anchors, such that the members receive sufficient support from said earth anchors to prevent rotation by the transfer of moment; and g. Securing a canopy cover to the canopy frame and/or earth anchors.

2. The method of claim 1 wherein the canopy cover is used as the ground template for determining the proper locations of the earth anchors.

* * * * *